US007687443B2

(12) United States Patent
Angelskaar

(10) Patent No.: US 7,687,443 B2
(45) Date of Patent: Mar. 30, 2010

(54) METHOD OF LUBRICATION OF CONDUITS FOR CEMENTITIOUS SLURRIES

(75) Inventor: Terje Angelskaar, Zurich (CH)

(73) Assignee: Construction Research & Technology GmbH, Trostberg (DE)

( * ) Notice: Subject to any disclaimer, the term of this patent is extended or adjusted under 35 U.S.C. 154(b) by 1253 days.

(21) Appl. No.: 10/523,845

(22) PCT Filed: Aug. 18, 2003

(86) PCT No.: PCT/EP03/09113

§ 371 (c)(1),
(2), (4) Date: Jul. 29, 2005

(87) PCT Pub. No.: WO2004/018334

PCT Pub. Date: Mar. 4, 2004

(65) Prior Publication Data

US 2006/0019837 A1 Jan. 26, 2006

(30) Foreign Application Priority Data

Aug. 20, 2002 (GB) ..... 0219347.2

(51) Int. Cl.
*C10M 169/04* (2006.01)
*C10M 145/28* (2006.01)

(52) U.S. Cl. ..... 508/180; 508/575; 508/389

(58) Field of Classification Search ..... 508/180, 508/575, 389
See application file for complete search history.

(56) References Cited

U.S. PATENT DOCUMENTS

| | | | | |
|---|---|---|---|---|
| 4,149,983 | A * | 4/1979 | Grier et al. | 508/257 |
| 4,461,712 | A * | 7/1984 | Jonnes | 508/507 |
| 5,193,942 | A | 3/1993 | Berry et al. | |
| 5,318,408 | A * | 6/1994 | Davidsson | 417/53 |

FOREIGN PATENT DOCUMENTS

| | | | |
|---|---|---|---|
| EP | 0593 815 A1 | | 4/1994 |
| GB | 2162 142 A | | 1/1986 |
| JP | 58021489 A | * | 2/1983 |
| JP | 60001291 A | * | 1/1985 |

* cited by examiner

*Primary Examiner*—Glenn Caldarola
*Assistant Examiner*—Jim Goloboy
(74) *Attorney, Agent, or Firm*—Curatolo Sidoti Co., LPA; Joseph G. Curatolo; Salvatore A. Sidoti

(57) ABSTRACT

A method of lubrication of the passage of a cementitious composition through a conduit, comprising the addition to the conduit prior to addition thereto of the cementitious composition of an aqueous solution of a solid lubricating composition consisting essentially of (i) an alkali metal carbonate or bicarbonate, (ii) poly(ethylene oxide), and (iii) anionic sulphate surfactant. The use of this composition allows the convenient achievement of flow, without the necessity to mix sometimes substantial quantities of cement slurry in situ.

19 Claims, No Drawings

METHOD OF LUBRICATION OF CONDUITS FOR CEMENTITIOUS SLURRIES

CROSS REFERENCE TO RELATED APPLICATIONS

This application is a national stage application of International Application No. PCT/EP2003/009113, filed Aug. 18, 2003, which claims the benefit of Application No. GB 0219347.2, filed Aug. 20, 2002, from which application's priority is claimed.

This invention relates to a method of lubrication of cementitious compositions delivered via conduits and to a composition for use with this method.

Cementitious compositions such as concrete and mortar sometimes have to be conveyed to a use site via a conduit such as a tube, pipe or hose. Typical examples of such conveying are the pumping of concrete for placing by spraying or by dropping into a shaft, such as a mine shaft. Cementitious compositions for such applications are generally quite thick and viscous, and they can easily cause blockages in the conduit or prove difficult to pump, especially at the beginning of pumping. In order to start them flowing in the conduit, a so-called "start up" composition or "line lubricant" is added to the conduit prior to the addition of the cementitious composition—if a pump is involved, this is often called a "pump primer".

Traditionally, this composition has been a relatively fluid cement slurry, typically 50:50 water/cement by weight. This works well, but it has several drawbacks. One of these is that quite large amounts (up to 120 Kg) may be needed. Even when the amount is a reasonable 30 Kg, there is still the necessity of handling cement powder and mixing the cement slurry on site, often in less-than-ideal conditions. Moreover, if pump priming is involved, the slurry must be prepared prior to addition to a feed hopper adjacent to the pump—it is not possible to mix cement powder and water in the hopper, as the cement powder initially sinks to the floor of the hopper and slurry formation is nearly impossible.

There has been interest in developing lubricating compositions that are not cement slurries, that can be dissolved or dispersed quickly in water and that avoid the disadvantages previously mentioned. Some materials have been used successfully in this application, but these have usually been liquid, generally mineral slurries, and their liquid natures bring their own handling problems, plus the possibility of stability and shelf life problems. There exists a need in the art for a solid lubricating composition that will overcome the disadvantages of the known art.

It has now been found that a particular solid composition dissolves rapidly and completely in water and improves considerably the delivery of a cementitious composition through a conduit. The invention therefore provides a method of lubrication of the passage of a cementitious composition through a conduit, comprising the addition to the conduit prior to addition thereto of the cementitious composition of an aqueous solution of a solid lubricating composition consisting essentially of (i) alkali metal carbonate or bicarbonate, (ii) poly(ethylene oxide), and (iii) anionic sulphate surfactant.

The alkali metal carbonate or bicarbonate may be a single carbonate or bicarbonate or a mixture of such carbonates or bicarbonates. While both carbonates and bicarbonates give equal performance, bicarbonates are preferred because the lubricating compositions including them have a lower pH (typically 8-8.5, as opposed to the approximately 12 obtained with carbonates), making them more pleasant to handle. The preferred material is sodium bicarbonate. The carbonate or bicarbonate is present in the lubricating composition to the extent of from 80-95% by weight of the total solid lubricating composition. The material is readily available in a variety of solid forms.

The poly(ethylene oxide) (PEO), which may be a single PEO or a mixture of PEOs, is a high molecular weight, having a weight-average MW of from 500,000-8,000,000 (preferably from 2,000,000-5,000,000). Such materials are readily commercially available, for example, the "Polyox" (trade mark) materials of Union Carbide Corp. The PEO is present in the lubrication composition to the extent of from 1-10%, preferably from 4-6%, solids by weight of the total lubricating composition.

The third essential component is at least one anionic sulphate surfactant. There is available a wide range of such materials, and two or more may be used. The preferred surfactant is an alkali metal lauryl sulphate, more preferably sodium lauryl sulphate. This is used in the lubricating composition to the extent of from 0.5-5%, more preferably from 1-2%, solids by weight of the lubricating composition.

The invention therefore also provides a lubricating composition consisting essentially of a solid mixture of from 80-95% of at least one alkali metal bicarbonate, from 1-10% of at least one poly(ethylene oxide) and from 0.5-3% of an alkali lauryl sulphate, all percentages being by weight of the total lubricating composition.

An optional, preferred, additional component is a water-soluble organic-functional acidic substance. By "organic-functional acidic substance" is meant any solid, water-soluble acidic compound that will dissolve in water to give a pH of less than 7 and that has organic content, for example, an organic functional group. Such acidic substances may be traditional organic acids, such as carboxylic acids, but this is not necessarily the case. A specific example of an organic-functional acidic substance useful in this invention is aminotri (methylenephosphonic acid), sold commercially, for example as "Dequest" (trade mark) ex Monsanto. Any such organic-functional acidic substance will work in this invention. It is possible to use more than one such acidic substance, but the preferred acidic substance is citric acid, used alone.

When such an acidic substance is present, it may be present to the extent of up to 10% by weight of the lubricating composition. It is preferably present to the extent of from 4-6%.

Although it is possible to add the individual components to water, it is much more convenient (and preferred) to add them as a single admixture. The preferred lubricating composition dissolves rapidly in water (preferably within 60 sec, more preferably within 30 sec) to give a solution with a pH of about 8-8.5. The solid lubricating composition is advantageously packaged in discrete, known amounts, ready for use, for example, in suitable containers, such as plastic bags or sachets. In a further embodiment, these containers may be water-soluble, and an appropriate number of bags may be added. In addition to the convenience of dosing (by simply adding the necessary number of containers), any dust hazard is removed.

The quantity of lubricating composition used in any given situation will depend on the conditions in that situation. Such conditions vary widely, but in every case the skilled person can ascertain an appropriate amount by simple experimentation. Typically, for the priming of a concrete pump, the total quantity of aqueous solution will be 20 Kg, containing typically from 1-2% by weight of lubricating composition.

The lubricating compositions for use in this invention are outstanding in lubricating performance and allow easier pumping or dropping of cementitious compositions.

The invention is further described with reference to the following non-limiting example.

Preparation of Lubricating Composition

The following materials are blended.

sodium bicarbonate* 93.5% (wt. solids)

* Solvay 0/50 poly(ethylene oxide)** 5%

** "Polyox" (trade mark) 301, ex Union Carbide Corp., weight-average MW 4,000,000.

sodium lauryl sulphate 1.5%

The resulting composition is packed into waterproof, easily-tearable plastic bags, each bag holding 200 gm.

Testing of Lubricating Composition

Two identical batches of concrete mix for pumping are prepared. The mix design is ordinary Portland cement (HCB Norino 4, CEM I) 42.5 Kg.

crushed aggregate 0-4 mm 1200 Kg.

crushed aggregate 4-8 mm 455 Kg.

Both mixes are pumped through a standard 8 cm. hose by means of a pump having an adjacent feed hopper, a type well known to the art.

In one case, 20 Kg. water is added to the hopper and the contents of a single bag containing 200 gm lubricating composition as hereinabove described is added to the water and the paddles in the hopper are operated to agitate and dissolve the composition. The composition dissolves completely within 60 sec. This solution is then pumped and a batch of the concrete mix is added to the hopper and pumped immediately afterwards. The concrete mix flows smoothly through the pump.

The other concrete batch is pumped using the traditional cement slurry. This also flows smoothly. However, this requires the prior mixing of a cement slurry consisting of a 50:50 weight blend of ordinary Portland cement and water. 30 kg of this slurry is then added to the hopper and pumped, the concrete batch being pumped immediately afterwards. More material is needed to prime the pump and more time and effort is required to achieve the same results as those obtained by the lubricating composition hereinabove described.

The invention claimed is:

1. A method of lubricating the passage of a cementitious composition through a conduit, comprising adding to the conduit prior to addition thereto of the cementitious composition, an aqueous solution of solid lubricating compositions consisting essentially of (i) alkali metal carbonate or alkali metal bicarbonate, (ii) poly(ethylene oxide), and (iii) anionic sulphate surfactant; and subsequently pumping or dropping the cementitious composition through the conduit.

2. A lubricating composition consisting essentially of a solid mixture of from about 80% to about 95% of at least one of an alkali metal carbonate or an alkali metal bicarbonate, from about 1% to about 10% of at least one poly(ethylene oxide) and from about 0.5% to about 3% of an alkali metal lauryl sulphate, all percentages being by weight of the total solid lubricating composition.

3. A lubricating composition according to claim 2, in which the composition additionally contains a water-soluble organic-functional acidic substance.

4. The method of claim 1 wherein if present the alkali metal bicarbonate is sodium bicarbonate.

5. The method of claim 1 wherein the anionic sulphate surfactant is sodium lauryl sulphate.

6. The method of claim 1 wherein the alkali metal carbonate or alkali metal bicarbonate, poly(ethylene oxide), and anionic sulphate surfactant are added as a single admixture to water to form the aqueous solution.

7. The composition of claim 2 wherein the alkali metal bicarbonate is sodium bicarbonate.

8. The composition of claim 2 wherein the alkali metal lauryl sulphate is sodium lauryl sulphate.

9. The composition of claim 2 wherein the poly(ethylene oxide) has a weight average MW of about 500,000 to about 8,000,000.

10. The composition of claim 2 further characterized in that the composition, when added to water in an amount of about 1% to about 2% by weight of water, dissolves in the water within about 60 seconds to produce a solution wherein the pH is about 8 to about 8.5.

11. The composition of claim 3 wherein the water-soluble organic-functional acidic substance is at least one of carboxylic acid or citric acid.

12. The composition of claim 3 wherein the water-soluble organic-functional acidic substance is aminotri(methylenephosphonic acid).

13. The composition of claim 3 wherein the water-soluble organic-functional acidic substance is present in an amount up to and including 10% by weight of the total solid lubricating composition.

14. A lubricating composition for cementitious compositions comprising a solid mixture of at least one of an alkali metal carbonate or alkali metal bicarbonate, a poly(ethylene oxide) and an alkali metal lauryl sulphate.

15. The composition of claim 14 wherein the alkali metal bicarbonate is sodium bicarbonate.

16. The composition of claim 14 wherein the alkali metal lauryl sulphate is sodium lauryl sulphate.

17. The composition of claim 14 wherein the poly(ethylene oxide) has a weight average MW of about 500,000 to about 8,000,000.

18. The composition of claim 14 further characterized in that the composition, when added to water in an amount of about 1% to about 2% by weight of water, dissolves in the water within about 60 seconds to produce a solution wherein the pH is about 8 to about 8.5.

19. The method of claim 6 wherein the single admixture is provided in a discrete amount in an easily tearable waterproof container or a water soluble container for adding to the water.

* * * * *